United States Patent [19]

Iwama

[11] Patent Number: 4,881,330

[45] Date of Patent: Nov. 21, 1989

[54] SKI BOOT

[75] Inventor: Shinichi Iwama, Saitama, Japan

[73] Assignee: Daiwa Seiko, Inc., Tokyo, Japan

[21] Appl. No.: 351,324

[22] Filed: May 29, 1989

Related U.S. Application Data

[63] Continuation of Ser. No. 146,421, Jan. 21, 1988, abandoned.

[30] Foreign Application Priority Data

Feb. 3, 1987 [JP] Japan ..... 62-23396

[51] Int. Cl.[4] ..... A43B 5/04; A43B 1/14

[52] U.S. Cl. ..... 36/117; 36/87; 523/167

[58] Field of Search ..... 36/117–121, 36/87; 524/413, 440, 443; 523/167

[56] References Cited

U.S. PATENT DOCUMENTS

| | | | |
|---|---|---|---|
| 3,895,452 | 7/1975 | Hanson et al. | 36/117 |
| 4,019,267 | 4/1977 | Sadler | 36/120 |
| 4,078,322 | 3/1978 | Dalebout | 36/121 |
| 4,085,528 | 4/1978 | Delery | 36/121 |
| 4,245,410 | 1/1981 | Molitor | 36/117 |
| 4,280,286 | 7/1981 | Sartor | 36/121 X |
| 4,463,058 | 7/1984 | Hood et al. | 524/443 X |
| 4,563,495 | 1/1986 | Kawaguchi et al. | 524/413 |
| 4,649,172 | 3/1987 | Yanase et al. | 524/413 |
| 4,780,575 | 10/1988 | Flavin et al. | 524/440 |

FOREIGN PATENT DOCUMENTS 52-118360 10/1977 Japan .

OTHER PUBLICATIONS

Din 7880—Teil 2, Sep. 1977.

*Primary Examiner*—James Kee Chi

*Attorney, Agent, or Firm*—Kalish & Gilster

[57] ABSTRACT

A ski boot consisting of an outer shell and an innerboot installed inside the outer shell. The outer shell is formed out of thermoplastic synthetic resin material mixed with a desired weight ratio of whisker. Mixing of whisker not only increases the flexural elasticity of thermoplastic synthetic resin material but also reduces the elastic distortion of the outer shell. Further, the abrasion-resistance of the outer shell is improved.

6 Claims, 2 Drawing Sheets

SKI BOOT

This is a continuation of U.S. patent application Ser. No. 07/146,421 filed on Jan. 21, 1988, now abandoned.

BACKGROUND AND SUMMARY OF THE INVENTION

The present invention relates to a ski boot comprising an outer shell and an innerboot, and, more particularly, to a skiing boot with improved flexural elasticity and abrasion-resistance.

A ski boot consisting of an outer shell and an innerboot is disclosed, for example, in Japanese Patent Application Laid-Open No. 52-118360.

Outer shells of this kind have been generally formed out of polyamidic, urethanic, or olefinic synthetic resin.

A ski boot is used to unite a skier's foot with a ski. It is supposed to fulfill various requirements, for example, for a stable slide over snow and a good cage-work when a skier turns to the right or to the left. In other words, a ski boot is expected to transmit the skier's movements to a ski directly and surely. More particularly, it is desired that when a skier expands or contracts his feet, leans his body forward, flexes his knees to the right or left alternately, or shifts his body balance forward or backward, every action of the skier's feet necessary for doing these various exercises should be transmitted to his skis surely and without any loss.

The outer shells now in use are formed only out of polyamidic or urethanic thermoplastic synthetic resin materials. These synthetic resin materials have comparatively small flexural elasticity. This leads to a disadvantage that even if a skier tries to transmit to his skis his ski-controlling movements, part of the energy is absorbed by elastic deformation of the outer shell. So the conventional prior art has failed to provide ski boots which enable transmissions of a skier's movements to his skis without any loss. This problem tends to become more serious for expert or professionsl skiers who slide over snow working their skis momentarily and aggressively.

The present invention is aimed at solving the above-mentioned problem. In more detail, it is an object of the present invention to provide a ski boot with high performance and good abrasion-resistance, which comprises an outer shell having a conventional shape and thickness but is improved in flexural elasticity permitting the full transmission of the skier's movements to his skis.

DESCRIPTION OF THE PREFERRED EMBODIMENT

Figure 1:
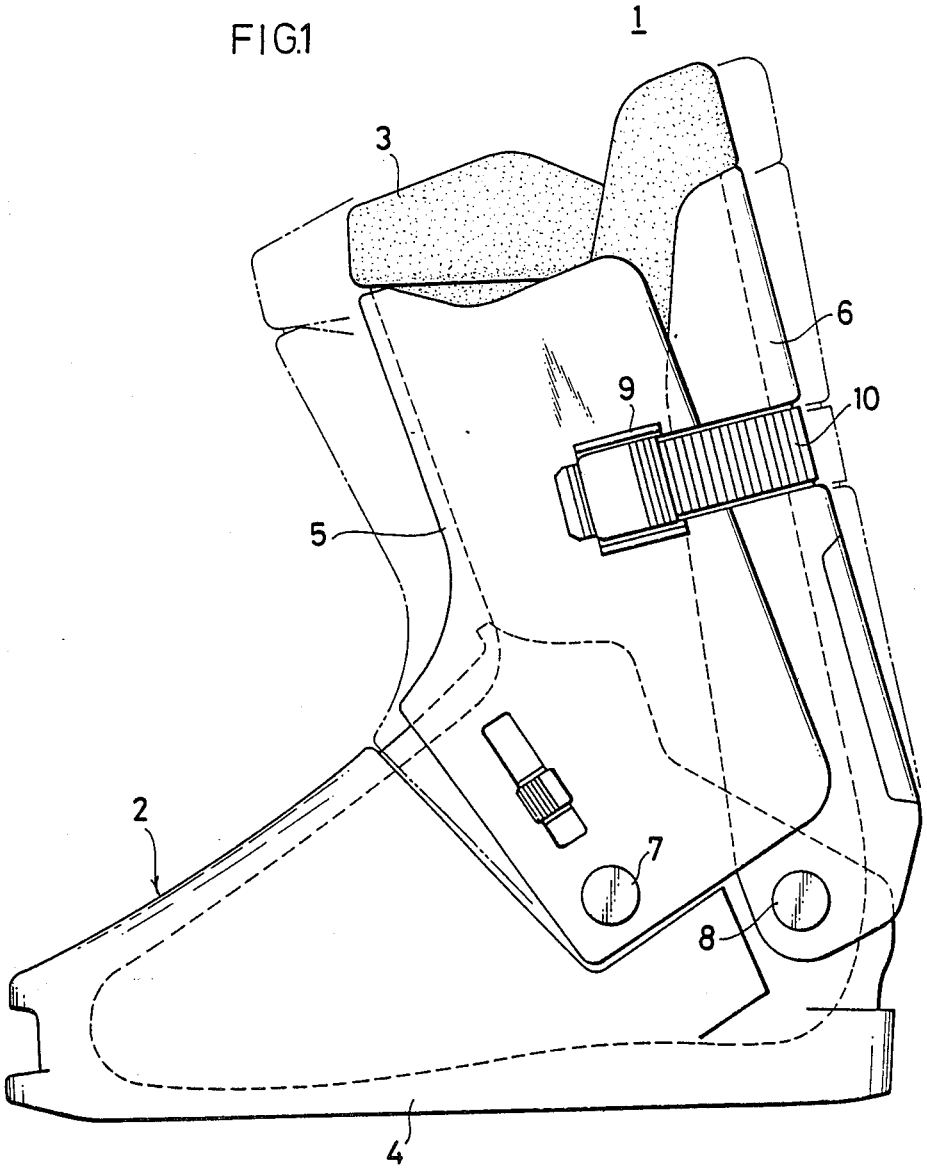
FIG. 1 is a side view showing the entire structure of one example of the ski boot according to the present invention.
Figure 2:
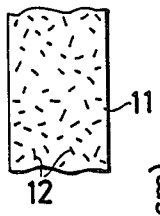
FIG. 2 is an enlarged explanatory view showing part of the molding material of the outer shell.

Referring now by reference characters to the drawings, FIG. 1 is a side view showing the ski boot attached with the outer shell according to the present invention having high flexural elasticity and good abrasion-resistance. The ski boot, which is indicated by at 1, consists of an outer shell 2 and an innerboot 3 installed inside the outer shell 2.

The above-mentioned outer shell 2 comprises a shell body 4 to cover mainly the portion below the ankle, a front cuff 5 to cover from the frontal portion of the ankle to the lower portion of the leg, and a rear cuff 6 to cover from the upper portion of the calf, the lower edge of the front cuff 5 being attached by means of a pin 7 to the ankle part of the shell body 4 in such a manner that the cuff 5 can slide obliquely forward and backward, and the lower edge of the rear cuff 6 being attached by means of a pin 8 to the heel part of the shell body 4 in such a manner that the cuff 6 can rotate forward and backward. The front cuff 5 is fixed with a fastening buckle 9 on its upper side, one end of a fastening band 10 to be hooked to the buckle 9 being fixed on the side of the front cuff 5 opposite to the buckle 9, the other free portion being wound around the outer periphery of the rear cuff 6 with its free end being bound by the buckle 9 so that the front cuff 5 and the rear cuff 6 can be fastened together.

The above-mentioned outer shell 2 or shell body 4, the front cuff 5 and the rear cuff 6 are formed out of the material which is made by mixing whisker 12 having needle-like crystals into polyamidic, urethanic, or olefinic thermoplastic synthetic resin in weight ratio of 1–15%.

The whisker 12 to be used for the present invention is from 0.1 to 1.0 μm in diameter, and from 50 to 200 μm long. Such whisker includes ceramic ones of silicon carbide, potassium titanate, or alumina, or metallic one of copper, iron or nickel.

It should be particularly noted that the addition of whisker 12 in molding resin into the shell body 4 bring about an improved abrasion-resistance. Further, when the amount of whisker to be contained in the resin is from 10 to 15% in weight ratio, the greatest effect can be obtained; damages to a boot due to the edge of a ski or other causes, damages and abrasion on the boot sole at the time of walking, and damages and abrasion at the portion which is hooked to a binding means can be reduced remarkably.

Table 1 shows the results of a comparison test in slide friction and abrasion between the compound material made by mixing 15% of whisker with nylon 6 and the conventional material only of nylon 6. The test was done under the conditions of pressure 4.1 kg/cm$^2$ and wind velocity of 60 cm/s.

TABLE 1

| | Conventional goods | The present invention |
|---|---|---|
| Mobile friction coefficient (μk) | 0.68 | 0.67 |
| Comparative abrasion amount (mm$^3$/kg-km) | 1.34 | 0.20 |

As clearly seen from the above Table 1, the present invention can reduce the abrasion amount remarkably. This means that the present invention is very effective to prevent the damages and abrasion of the shell 4.

The test also showed that if the content of whisker exceeds 15% and becomes more than 20% the shell increases in hardness, while it becomes fragile. The most preferable amount of whisker to be contained in thermoplastic synthetic resin is, therefore, around 5%.

Table 2 shows the results of a comparison test using the resin material of nylon 6 with respect to flexural strength and elasticity of the present invention and the conventional goods.

TABLE 2

| | Conventional Goods | The Present Invention |
|---|---|---|
| Flexural strength (kg/cm$^2$) | 530 | 530 |
| Flexural elasticity (kg/cm$^2$) | 13300 | 9500 |

As will be clear from Table 2, the compound material of nylon 6 and whisker 12 according to the present invention is able to increase the flexural elasticity remarkably. This is very effective increase the strength against torsion and flexion and also to increase the forward lean torque of the front and rear cuffs. This means that the material according to the present invention is full of resilience and can produce a very resilient ski boot.

Figure 3:
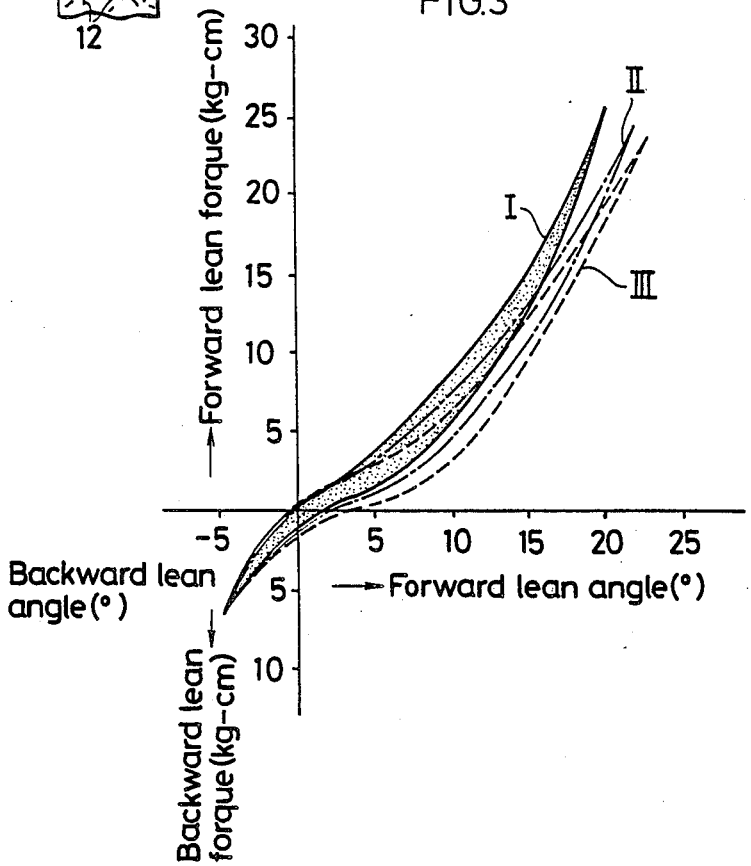
FIG. 3 is a graph showing the forward and backward lean properties of both the present invention and the conventional goods.

FIG. 3 is a graph obtained from the test results with respect to the realtionships between the angle and torque when the front cuff 5 and the rear cuff 6 of the ski boot are moved obliquely to the forward and backward lean positions respectively as shown by the two-dot chain line in FIG. 1.

In this FIG. 3, both the curve I shown by a solid line and the curve II shown by a one-dot line represent the forward lean and backward lean properties of the ski boot according to the present invention; the form is the case where the outer shell 2 is formed out of the resin containing 5% of whisker, while the latter is the case where the amount of whisker is 1%. The dotted line III shows the property of a conventional ski boot. It should be noted here that the reason why both properties make hysteresis curves is that the front cuff 5 and the rear cuff 6 are attached to the shell body 4 by means of a pin 7 in such a manner that these cuffs can move slantwise.

As well be clear from the graph of FIG. 3, the present invention can provide a ski boot which enables sharper edge-work because, as the flexural elasticity of the outer shell 2 increases, the forward lean torque gets bigger than a conventional boot and also improved resiliency helps produce a resilient ski boot. In other words, the skiing boot according to the present invention can transmit the skier's movement to the ski surely and efficiently. This means that the present invention can provide a ski boot with performance high enough to satisfy even professional skiers.

Table 3 is referring to the comparative test results of the relationships between the whisker content and the color tones when ceramic whisker is employed.

It is seen from Table 3 that, when pigment is red or black, the most suitable content of whisker is not more than 2% in order to maintain the best exterior color tone.

TABLE 3

| Content Wt % | Color White | Red | Black |
|---|---|---|---|
| 1 | O | O | O |
| 2 | O | O | O |
| 3 | O | Δ | Δ |
| 4 | O | Δ | Δ |
| 5 | O | Δ | Δ |
| 6–10 | O | Δ | Δ |
| 11–15 | O | Δ | Δ |

NOTE: The above table shows a comparison in color tone of each color using the same pigment to the whisker of 0Wt%.

O: Good (almost no changes seen)

Δ: Whitish and a little degraded in exterior color tone

As will be seen from the foregoing disclosure, the present invention wherein the outer shell essentially constitutes a ski boot formed out of thermoplastic synthetic resin mixed with whisker can improve the flexural elasticity of the outer shell to such a degree that it can transmit the skier's movement to his ski efficiently and let the ski work with higher performance. Another advantage is that, thanks to the improved elasticity, the strength of the ski boot against torsion and bending increases enough to make the outer shell thinner and lighter. Further, the addition of whisker can improve abrasion-resistance of the outer shell and, therefore, reduce the damages to, or abrasion of, the outer shell effectively.

What is claimed:

1. A ski boot having improved flexural elasticity and abrasion resistance essentially consisting of an outer shell and an innerboot installed inside said outer shell, characterized by the fact that said outer shell is formed out of thermoplastic synthetic resin mixed with a desired amount of whisker.

2. A ski boot as defined in calim 1, wherein said thermoplastic resin contains 1 to 15% of whisker in weight ratio.

3. A ski boot as defined in claim 2 wherein said whisker is ceramic selected from the group consisting of silicon carbide, potassium titanate and alumina.

4. A ski boot as defined in claim 2 wherein said whisker is metallic selected from the group consisting of copper, iron and nickel.

5. A ski boot as defined in claim 2 wherein said whisker is from 0.1 to 1.0 μm in diameter and from 50 to 200 μm long.

6. A ski boot as defined in claim 2 wherein said thermoplastic resin contains 10–15% of whisker in weight ratio.

* * * * *

UNITED STATES PATENT AND TRADEMARK OFFICE

CERTIFICATE OF CORRECTION

PATENT NO. : 4,881,330

DATED : November 21, 1989

INVENTOR(S) : S. Iwama

It is certified that error appears in the above-identified patent and that said Letters Patent is hereby corrected as shown below:

Col. 4, li. 40, delete "calim" and insert --claim--.

Signed and Sealed this

Sixteenth Day of October, 1990

*Attest:*

HARRY F. MANBECK, JR.

*Attesting Officer*

*Commissioner of Patents and Trademarks*